US005230857A

United States Patent [19]

Cook et al.

[11] Patent Number: 5,230,857

[45] Date of Patent: Jul. 27, 1993

[54] STRIP ELONGATION CONTROL IN CONTINUOUS ANNEALING FURNACES

[75] Inventors: Eugene A. Cook, King of Prussia, Pa.; Robert J. Mieloo, Hamilton, Canada

[73] Assignee: Selas Corporation of America, Dresher, Pa.

[21] Appl. No.: 950,792

[22] Filed: Sep. 24, 1992

Related U.S. Application Data

[60] Division of Ser. No. 615,900, Nov. 20, 1990, Pat. No. 5,174,835, which is a continuation-in-part of Ser. No. 440,193, Nov. 22, 1989, abandoned.

[51] Int. Cl.[5] ..... C21D 9/573

[52] U.S. Cl. ..... 266/90

[58] Field of Search ..... 266/90, 103

[56] References Cited

U.S. PATENT DOCUMENTS 4,061,508 12/1977 Moreau ..... 266/90

4,375,283 3/1983 Shimoyama et al. ..... 266/44

4,913,748 4/1990 Sellitto et al. ..... 148/128

FOREIGN PATENT DOCUMENTS 179819 8/1986 Japan ..... 266/90

*Primary Examiner*—Melvyn J. Andrews

*Attorney, Agent, or Firm*—John F. A. Earley; John F. A. Earley, III

[57] ABSTRACT

Strip elongation in a continuous annealing furnace is controlled by passing the strip around a first driven roll, thence through a portion of the furnace, thence around a second driven roll, wherein the elongation of the strip is sensed. One method is to sense the amount by which the peripheral speed of the second roll exceeds the peripheral speed of the first roll. Roll speeds are monitored by precision resolvers. Another method is to utilize a strip width measurement to determine elongation. Mechanisms are used for profiling tension throughout the furnace length.

20 Claims, 3 Drawing Sheets

STRIP ELONGATION CONTROL IN CONTINUOUS ANNEALING FURNACES

This application is a division patent application of U.S. patent application Ser. No. 07/615,900 filed Nov. 20, 1990 now U.S. Pat. No. 5,174,835 which is a continuation-in-part patent application of U.S. patent application Ser. No. 440,193 filed Nov. 22, 1989 now abandoned.

This invention relates generally to continuous annealing furnaces for steel strip.

BACKGROUND OF THE INVENTION

In vertical continuous annealing furnaces a single strand of cold rolled steel strip passes through several zones for heating, soaking and cooling, to recrystallization anneal and perform associated quenching and overageing treatments. For sheet steel annealing with overageing, the annealing cycle typically lasts 5–10 minutes. Strip speed in these furnaces can be as high as 450 mpm for sheet gauges and 650 mpm for tinplate gauges, as dictated by productivity considerations. The length of the furnace is minimized by passing the strip up and down (sinusoidally) over driven support rolls.

The strip moves through the furnace under tension to ensure good conformance to the driven support rolls, and, in combination with roll contours and steering mechanisms, to prevent excessive lateral strip motion leading to mistracking. The application of tension to the strip at high temperature also pulls out cold rolling shape defects through plastic elongation, the extent of which depends on the tension applied, on the steel's deformation resistance, and on the time during which the tension acts on the steel while it is soft enough Lo be deformed by norma values of strip tension. Conventionally, strip tension inside continuous annealing furnaces is most simply controlled by pulling the strip between entry and exit bridles to generate the uniform tension profile. Strip tension can be controlled locally along the furnace by regulating the speeds of individual rolls relative to the strip speed, to step tension up or step tension down to appropriate levels. This procedure will be illustrated below.

Strip tension may also be regulated in discrete zones by using bridles inside the furnace. A bridle is a combination of two or more juxtaposed rolls positioned so as to maximize surface contact between the strip and at least one of the rolls, the latter being a driven roll. In these conventional schemes, tension is regulated at predetermined levels as measured by load cells, which provide a measure of the vertical or horizontal force (e.g., total load) on various support rolls. The appropriate total load used in a particular furnace section depends on strip cross-section (width and thickness), strength (depending on temperature, state of recrystallization and chemical composition), and the need for elongation flattening. The load is limited by the need to prevent creasing, over-necking (the width reduction associated with elongation) and strip breaks. The soaking section is the most critical area for tension control, because the yield strength of the strip is lowest there, typically about 1,000 psi for ultra-low carbon steel at 850°–900° C., making it most susceptible to tension effects.

The range of total load required in a furnace which processes a wide range of strip cross-sections and grades (composition and annealing temperature) makes precise control at the low end of the range difficult because the "dead band" of the best load cells, typically ±1 percent of full rated load, represents a large fraction of the total load needed for small cross-sections and soft grades. Harmonic strip flutter also causes actual strip tension fluctuations which broaden the band of uncertainty in load cell measurements. The accuracy of load cell regulation is further limited by the difficulty in distinguishing small changes in strip load in a total load cell signal imposed by strip load and roll weight.

1.1 Analysis

The tension pattern through a vertical annealer, and particularly for one with galvanizing capability, is one with high tension at the entry and exit ends and low tension in the middle section where the strip is hot and plastic.

Strip enters the furnace, from the cold mills where it is reduced up to 85% with very large induced stresses which are not uniform, resulting in irregular flatness across the strip width, and with various frequency of such defect lengthwise of the strip. Since such strip enters the furnace cold, its contact with the conveyor rolls is irregular and high tension is required to increase its contact area to avoid slippage and sideways mistracking. This condition is highly aggravated by the thermal difference between the conveyor rolls which are near furnace temperature and the cold strip. Because of thermal conductivity those portions of the strip with short fiber length in good contact with the roll overheat compared to those portions of long fiber length. While this condition tends to ultimately correct strip shape when the strip begins to yield, it further affects tracking and the possibility of strip collapse, or heat buckling, later in the furnace.

The cold strip over the hot rolls further cools the portion of the roll in contact with the strip by conduction and radiation. The portion of the roll not in contact with the strip remains near furnace temperature and hence its diameter growth by thermal expansion is greater. To avoid gross mistracking of the strip due to subsequent concaving of the roll, the roll ends are tapered in cold condition. This requirement presents two other problems; namely, a stress rising point where the taper initiates, and a greater temperature difference across the sheet. This latter condition is further aggravated on a strip width change of larger size whereby the width addition contacts a portion of the roll hotter than the original extended center portion.

As the strip travels in this entry section of the furnace its temperature increases and some flattening, or removal of stresses, occurs as its yield point lowers due to temperature. When the strip temperature reaches a point where extension begins to occur the strain rate (function of tension) must be significantly decreased to avoid over-extension and consequent narrowing of the strip which would occur at the strain rates required at the furnace entry described above.

In the heating zone, the conveyor rolls in prior practice have been powered only to overcome the roll inertia upon speed changes. This practice does not provide for lowering the required high entry tension to the required low tension at the soak zone. Thus, bridles are used at the entry of the soak zone which abruptly changes the tension, FIG. 5. This practice is unsatisfactory however, since during transient changes of speed which occur very often, product on the high tension side of the bridle reaches peak temperature promoting heat buckles or coil breaks before the heating controls can respond.

When the strip has reached it aim setpoint temperature, it is held at the temperature for a period of time to allow all the carbon content to recrystallize, and to bring all portions of the strip across its width to the same temperature as far as possible due to the discrepancies above.

During this time final flattening of the strip is obtained by extension of the strip. This extension, however, should be carefully controlled as tensions, or strain rates, which are too high can cause heat buckles, and can over-extend the sheet causing more narrowing than necessary to flatten. Excessive narrowing requires more width at the pickle line and is more difficult to keep in commercial tolerance.

On both sides of the holding section the strip is at a temperature where both elastic and plastic extension occur. If extension and narrowing are to be kept at a minimum and controlled more easily, these areas should be kept at a lower strain rate (tension) to minimize the plastic or permanent extension and to keep the permanent extension more controllable.

The rolls in these areas again should be designed as multi-rolled bridles or a series of bridles to accomplish the required tension changes in stepwise fashion. While designing in this fashion requires more horsepower and more individual control than is the custom, expense Can be justified in the material cost savings of the controlled narrowing.

The exit end of the annealer, following cooling to a nonplastic temperature range, requires a high tension to provide a very stable passline for coating in the case of galvanizing, and to prevent strip flutter causing uneven cooling and scratching in the highly dynamic final cooling sections of both annealers and galvanizers.

As the very critical soaking zone is sensitive to all changes of tensions, particularly those induced during changes of line speed, this section should be considered as the master speed section of the processing line such that all transient errors in the drive system are driven to the ext and entry ends, thus minimizing the magnitude of such transients in the process section. To accomplish this as well as provide the tension buildup, all rolls in this section should be designed as a multi-rolled bridle.

1.2 Flatness Defects

Tension plays a small part in the generation of flatness defects as long as it is applied and changed correctly with operating practice. The type of steel, its temperature and time at temperature dictate the stress required for a given extension required for flattening a given incoming shape and I value. Roll crowns for tracking are dictated by furnace type and design and if properly designed especially at taper break points contribute minimally to defects. The primary cause of defects is non-uniformity of temperature.

Temperature differences across the width in the heating section are fairly negated by the high yield strength of the strip which allows large elastic changes. Some differences do exist due to the uneven contact of cold strip to hot rolls which can be alleviated somewhat by roll shields. These resultant differences are, however, mostly removed n the soaking section with sufficient time to recrystallize the carbon content.

Heat buckles are caused almost entirely by subjecting hot strip to cold rolls and this can be highly aggravated by nonuniform strip temperature. This phenomenon occurs mostly in the first cooling section. Heat buckles can occur in the soaking section if excessive tension is used in conjunction with other faults such as misaligned rolls, edge over-cooling by cold atmosphere distribution or with full crowned or heavily tapered rolls.

Rolls in the cooling section are greatly influenced by the cooling medium temperature and by the walls which are also cooled by this medium. These cod rolls quench the strip where it is in heavy contact as opposed to much lesser cooling where there is light or no contact. The rolls are provided with surrounding electric heating elements to help overcome this cooling effect, and the rolls should be kept within 75° F. of the strip temperature, if possible.

The rolls have a very high thermal inertia which cause shape problems on changes such as width or speed. Roll temperatures will stabilize in steady operation with the portion under the strip hotter than the other portions. If the succeeding strip width is larger, this larger portion will then contact a colder portion of the roll and over cool relative to other portions of this strip. This cooled portion is restrained from contracting by the remainder of the strip and becomes elongated, usually in the plastic state, and upon further cooling yields wavy edges. This condition may exist in about 4000 foot of strip before acceptable temperature difference of strip to roll is reached.

Whenever a gauge change occurs necessitating a line speed change, there is always a large temperature difference in the strip across the weld which may persist for 1200 feet on either side of the weld. Likewise, on line slowdowns, long portions of the strip will overheat due to the furnace inertia before coming back into control. When these temperature overshoots associated with speed change become too large, heat buckles will occur until the strip and roll temperatures converge to acceptable limits The auxiliary roll heating elements are too slow reacting to alleviate this problem. Lowering the tension during these transitions will help, but may not cure the problem.

A similar problem can exist in the heating section on a line slowdown since the strip will reach temperature earlier in the furnace and hence in a position where the tension is higher than desired. If this tension (set for elastic flattening and now acting on plastic strip) is too high, excessive extension and heat buckling can occur.

Such changes as described can be anticipated and feed forward signals sent to the furnace sections controls to avoid or minimize the damage. Usually, however, this requires the use of a mathematical model as the changes are too numerous and fast for an operator to calculate and react.

The initial cooling of the strip on the rolls and by the cooling medium itself may cause the flatness defect called cross bow. When hot strip passes over a colder roll, the strip face in contact with the roll cools to a greater extent than the back face. If the temperature difference between strip and roll is too great longitudinal camber will occur on the roll due to the contraction of the contact face. As the strip leaves the roll and is subject to tension stretching, the strip width will contract on the colder face more than that of the back face, and if the resulting strain is large enough to cause plastic deformation a cross bow will occur. Cross bow may also occur in like manner but reverse direction in the heating zones although these are usually in the elastic stage and are easily removed. However, it is possible, particularly above 500° F., to occasion plastic deformation if the temperature difference between the strip and the roll is too great. Such bowing requires more extension in soak to remove.

GENERAL DESCRIPTION OF THE THIS INVENTION

In view of the problems and shortcomings described above, it is an object of one aspect of this invention to provide a means for controlling strip elongation in a continuous annealing furnace, which does not require load cells, and which provides a far greater degree of accurate control of the tension in the strip than that afforded by load cells.

More particularly, this invention provides a method of controlling strip elongation in at least a portion of a continuous annealing furnace or the like, comprising the steps:

a) passing the strip around a first driven roll, upstream of said portion of furnace, thence through said portion of the furnace, thence around a second driven roll downstream of said portion of the furnace, the strip undergoing frictional contact with both rolls, and a[1]) sensing the elongation of the strip, and b) controlling strip elongation by adjusting the amount by which the peripheral speed of the second roll exceeds the peripheral speed of the first roll.

Further, this invention provides, in a continuous strip annealing furnace containing a portion in which it is desired to elongate the strip and to control such elongation, the improvement comprising the provision of:

a first driven roll adjacent the upstream end of said portion and a second driven roll adjacent the downstream end of said portion, the rolls being such as to achieve frictional contact with the strip when the latter is entrained thereover, driving means for driving both said rolls such that the peripheral speed of the second roll is greater than the peripheral speed of the first roll, thereby elongating the strip, and sensing means for sensing the elongation of the strip, and control means for adjusting the rotational speed of one of said driven rolls with respect to the other, thus controlling said elongation.

Further, this invention provides, in combination:

a continuous strip annealing furnace containing a portion in which it is desired to elongate the strip and to control such elongation, a first driven roll adjacent the upstream end of said portion and a second driven roll adjacent the downstream end of said portion, the rolls being such as to achieve frictional contact with the strip when the latter is entrained thereover, driving means for driving both said rolls such that the peripheral speed of the second roll is greater than the peripheral speed of the first roll, thereby elongating the strip, and sensing means for sensing the elongation of the strip, and control means for adjusting the rotational speed of one of said driven rolls with respect to the other, thus controlling said elongation.

This invention, in a preferred embodiment, also provides a method of controlling these problems comprising the tension steps shown in FIG. 4. Achieving this tension profile requires:

a) providing each roll with additional power and individual control to not only overcome its own inertia but to provide energy for increasing or decreasing strip tension.

b) Providing each roll drive with a ratio bias (auctioneering block) such that each pair of rolls or series of rolls can step the tension down progressively in whatever pattern is required, within the power provided to and the friction factor of the rolls.

Thus, in this embodiment, all the furnace rolls in combinations act as thermal stretcher-tension levelers with decreasing tension as the strip temperature increases.

In like manner, the furnace rolls following the as jet cooling section are also equipped for the purpose of increasing tension stepwise as the strip temperature decreases, thus providing the high tension required by after-furnace processes.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
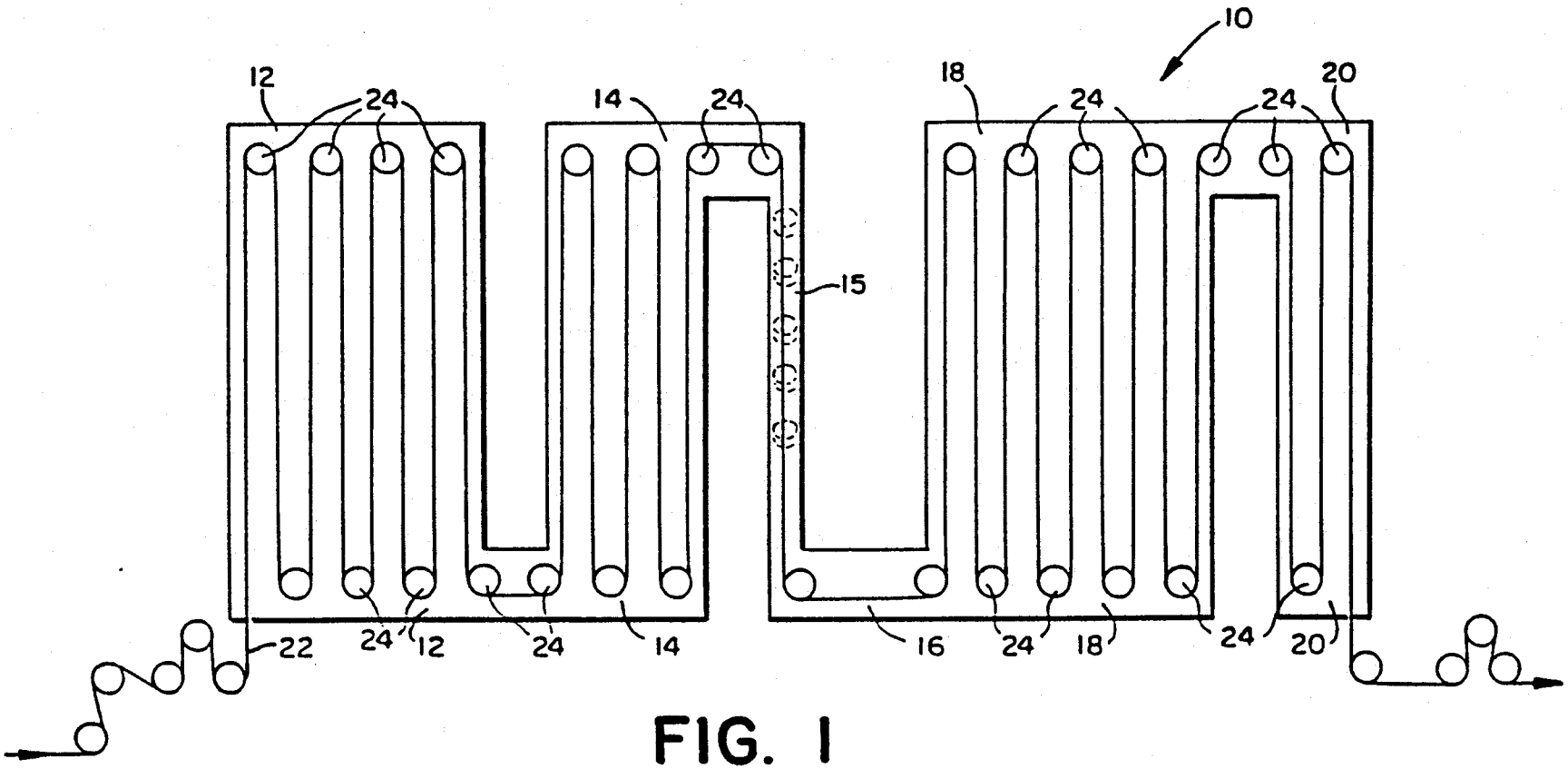
FIG. 1 PRIOR ART
FIG. 1 is a schematic vertical and axial sectional view of a continuous annealing furnace for handling steel strip, representing the prior art.

FIG. 1 shows a typical furnace 10 of the prior art, containing a heating zone 12, a soaking zone 14, and a cooling region which includes a gas et cooling zone 15, a primary cooling zone 16, an overageing zone 18, and a final cooling zone 20. As can be seen, the strip 22 passes over and under a series of rollers 24 in a sinusoidal or boustrophedonic configuration, this being typically used in order to conserve space and allow the furnace to be made with the least possible axial length. The schematic drawing of FIG. 1 does not include heating coils or jets, or any of the other means used to control temperature within the furnace. These are well known to those skilled in the art.

Figure 2:
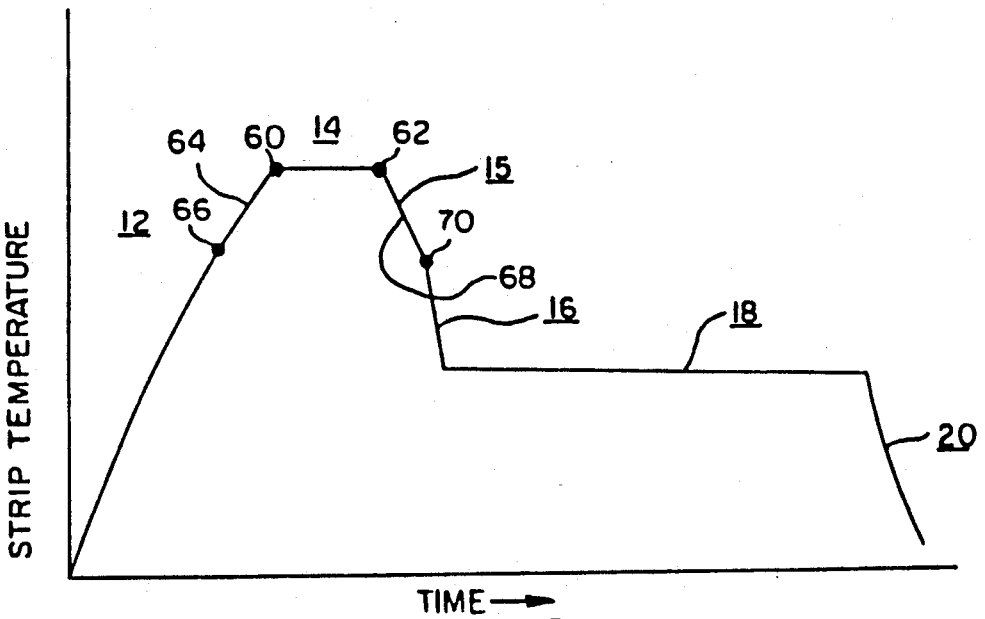
FIG. 2 is a graph showing various temperature contours within the furnace of FIG. 1.

FIG. 2 identifies the various zones and shows a typical temperature profile within a conventional furnace.

Figure 3:
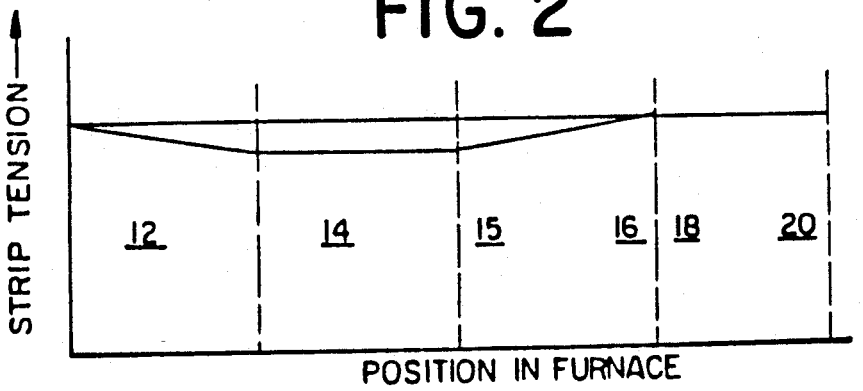
FIG. 3 PRIOR ART
FIG. 3 is a graph of strip tension vs longitudinal position through a continuous annealing furnace, when the tension is maintained uniform throughout the furnace, thus representing the prior art.
Figure 4:
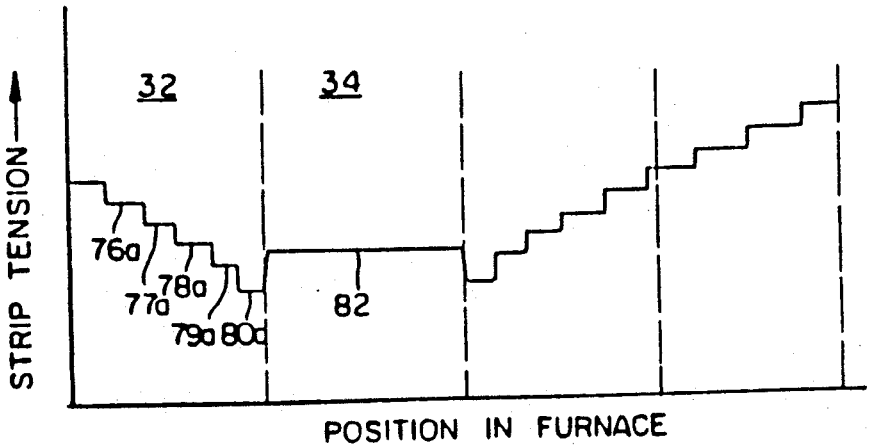
FIG. 4 is a graph similar to that of FIG. 3, but showing how a combination of driven and speed-controlled rollers in accordance with the invention can bring about a variation of strip tension throughout the furnace.
Figure 5:
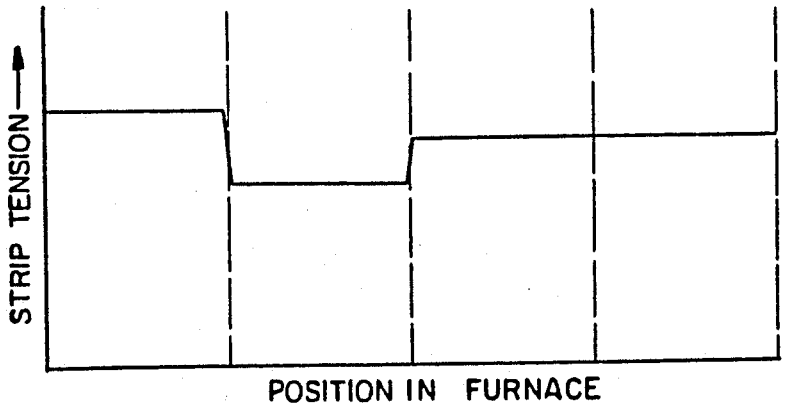
FIG. 5 PRIOR ART
FIG. 5 is a graph similar to that of FIG. 3, showing a different prior art tension scheme from that of FIG. 3.

FIG. 3 is representative of one prior art technique which the tension of the strip remains constant throughout the furnace. FIGS. 4 and 5 show additional tension profiles which can be obtained by introducing controlled-speed rolls at various locations within the furnace, with FIG. 4 showing a profile in accordance with the invention and FIG. 5 showing the prior art.

Figure 6:
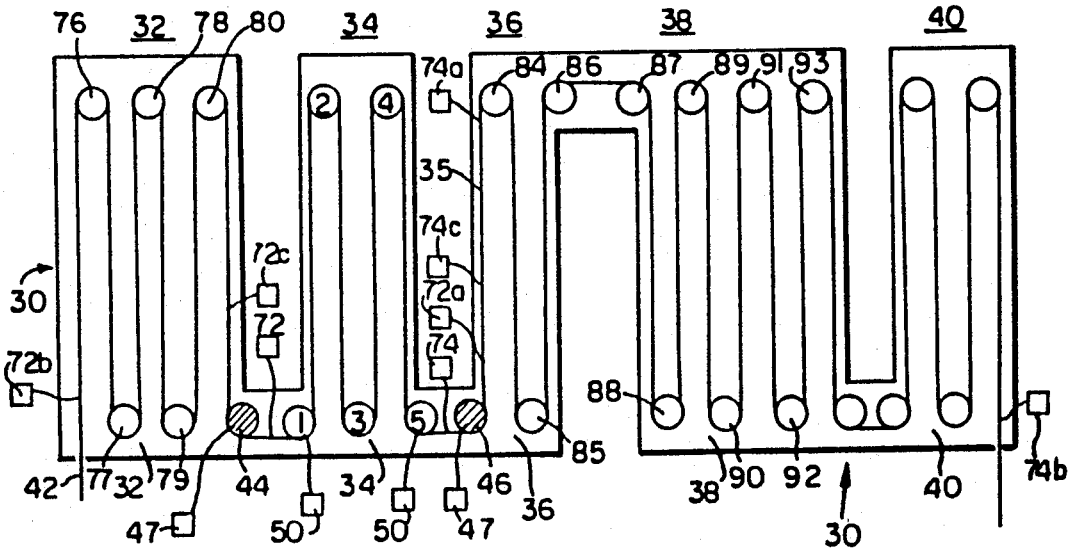
FIG. 6 is a view similar to that of FIG. 1, but showing a furnace to which this invention has been applied.

This invention includes sensing the elongation of the strip and in controlling strip elongation between two specific rolls, by adjusting the amount by which the peripheral speed of the downstream roll exceeds the peripheral speed of the upstream roll. This can be clarified by reference to FIG. 6, which shows a modified furnace 30, having a heating zone 32, a soaking zone 34, and a cooling region which includes a primary cooling zone 36, an overageing zone 38, and a final cooling zone 40. As can be seen in FIG. 6, the strip 42 passes around an internal roll 44 which lies between the heating zone 32 and the soaking zone 34, thence around rollers 1, 2, 3, 4 and 5 within the soaking zone 34, thence around a further roller 46 between the lo soaking zone 34 and the primary cooling zone 36. The rolls 44 and 46 thus bracket the soaking zone 34. In accordance with the invention, strip elongation taking place within the soaking zone 34 is controlled by adjusting the speeds of rotation of the rolls 44 and 46. More particularly, this is done by controlling the amount by which the peripheral speed of the downstream roll 46 exceeds the peripheral speed of the upstream roll 44.

In accordance with one preferred aspect of this invention, the rolls 44 and 46 are equipped with precision resolvers 47, which monitor rotational speed and sense the elongation of the strip. In a steady state operation, the elongation of the strip 42 in the soak zone 34 is then easily calculated on the basis of the difference in rotational rates between the rolls 44 and 46, and the size of the rolls.

If desired, strip elongation between the rolls 44 and 46 can be further controlled by controlling the speed of one or more of the intervening rolls 1, 2, 3, 4 and 5. This may be set by an "auctioneering block" which automatically distributes the strip elongation at the preset value as represented below:

$$\frac{\text{Roll } B \text{ RPM} - \text{Roll } A \text{ RPM} \times 100}{\text{Roll } A \text{ RPM}}$$

where B is the downstream roll 46 and A is the upstream roll 44.

If desired, the strip in the heating zone of the furnace may be controlled in the normal way, based on load cells feeding back to individual roll speeds in order to achieve the tapered tension. However, in accordance with a preferred aspect of this invention, load cell regulation is dispensed within the soak zone 34 where the strip softens and becomes easily deformable.

Figure 7:
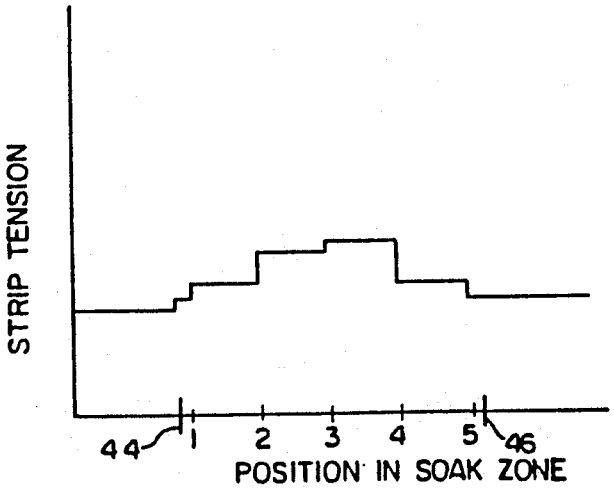
FIG. 7 is a graph of strip tension vs position in the soak zone only of a furnace, showing how it is possible to adjust strip tension within a given zone.

With the elongation control provided herein, soak zone roll drive motors must be powerful enough to do the work of plastic elongation required in each pass. This is opposite the requirements for roll motors used in tension Control schemes where the bridles do the work of elongation and roll drives operate at low power so as not to disturb tension uniformity in the soak zone. As previously mentioned, a consequence of the elongation control system provided herein could be a non-uniform, stepped, tension profile through the soak zone, allowing the strip to be a higher or lower tension in some passes than in others, or to cause the strip to increment to tensions different from the soak zone entry or exit tensions. An example is shown in FIG. 7, and also in FIG. 4.

Those skilled in the art will also appreciate that the elongation control system described above can be utilized in any of the various zones of a typical annealing furnace For example, in FIG. 6, the system of this invention could be utilized n the primary cooling zone 36, which typically uses air jet cooling.

Attention is again directed to FIG. 6, which shows two resolvers 50 which monitor the speeds of the driven rolls 44 and 46 by making measurements on the freely rotating non-driven rolls 1 and 5 respectively, which are adjacent to the driven rolls. It will be understood that, unless the freely-rotating rolls 1 and 5 are directly adjacent their corresponding driven rolls 44 and 46, there may be some additional elongation of the strip between each driven roll 44, 46 and its respective freely rotating rolls 1 or 5. In such a case, the strip distance over which the elongation is taken to occur would be the distance between the freely rotating rolls 1 and 5, and not the distance between the rolls 44 and 46. The advantage of this arrangement is that it allows the avoidance of what is called the "slip angle" between a driven roll and a moving strip in contact with the driven roll. By resolving a non-driven roller (rollers 1 and 5) one obtains 100% accuracy of speed. There is thus no dead-band which, if present, could contribute a 0.1% error.

Although the foregoing discussion describes the use of resolvers 47 for determining the rotational speed of the rolls, those skilled in the art will appreciate that alternative methods are also available.

Referring now to FIG. 2, and the strip temperature graph of FIG. 2, there is shown soaking zone 14 which is defined by points 60 and 62, entrance shoulder 64 which is defined by point 66 and point 60, and exit shoulder 68 which is defined by point 62 and point 70. The strip in entrance shoulder 64 is in the final heating section of heating zone 12 and is probably plastic. The strip in soaking zone 14 is all plastic, and the strip in exit shoulder 68 is partly plastic.

Another method of measuring elongation of the strip is by measuring the width of the strip which is directly related to the length or elongation of the strip. Such measurements may be made with precision strip width gauges which measure the width of the strip continuously and do not contact the strip. Such gauges are available from M.A. Incorporated, of 2600 American Lane, Elk Grove Village, Ill. 60007, and other manufacturers. Such gauges measure to an accuracy of ±0.010 inches at strip speeds of up to 5,000 ft./minute and measure widths up to 84 inches. This is a direct electronic measurement, with no gearing or wear points. The gauge produces a direct digital readout, not a deviation. A strip width gauge includes a gauge head with two vertical beam laser seekers, two electro-servo laser beam positioners, remote push-button operator's control, remote computer and digital display, and optional printer.

Referring to FIG. 6, a strip width gauge 72 is mounted adjacent to and downstream of first roller 44, and another strip width gauge 74 is mounted upstream and adjacent to second roller 46. Gauges 72 and 74 measure the width of the strip, and from the differences in width of the strip between first roller 44 and second roller 46 it is possible to calculate the elongation of the strip between first and second rollers 44, 46, using Poisson's Ratio for the strip material.

If it is desired to measure the elongation of the strip in the gas-jet cooling zone 35, as shown in FIG. 6, a strip width gauge 72*a* is mounted at the entrance to gas-jet cooling zone 35 and a strip width gauge 74*a* is mounted at the exit of gas-jet cooling zone 35.

If it is desired to sense the elongation of the strip by measuring the difference in width of the strip at the entrance and exit ends of the furnace 30 of FIG. 6, a strip width gauge 72*b* is mounted at the entrance of the furnace 30 and a strip width gauge 74*b* is mounted at the exit end of furnace 30.

If it is desired to sense the elongation of the strip by measuring the difference in width of the strip between the entrance point 66 of the entrance shoulder 64 and the exit point 70 of the ext shoulder 68 (FIG. 2), a strip width gauge 72*c* (FIG. 6) is mounted at the entrance shoulder point 66, and a strip width gauge 74*c* is mounted at ext point 70 of shoulder 68.

It is desirable to decrease the tension on the strip as it passes through heating zone 32 to soaking zone 34 from the high level of tension required for strip tracking to a lower tension adapted for controlling the elongation of the strip without damaging the strip and this is accomplished by adjusting the speed of rollers 76–80 in heating zone 32 to decrease the tension in the steps indicated by the steps 76*a* to 80*a* as shown in heating zone 32 in FIG. 4.

The tension in entrance zone 64 (FIG. 2) is decreased below the desired tension 82 in soaking zone 34 (FIG. 4) at the entrance shoulder zone of the soaking zone in order to minimize the elongation of the strip in the entrance shoulder zone 64. Similarly, rollers including rollers 84–86 (FIG. 6) in the primary cooing zone 36 first reduce the tension in the strip in the exit shoulder 68 and then incrementally raise the tension to the tension desired when the strip leaves the overageing zone. The rolls are provided with sufficient power and individual control for increasing or decreasing tension on the strip by using all of the rolls or any combination of them.

By directly monitoring strip elongation in the soak zone (and/or other zones such as the jet cooling zone), the following advantages arise as compared to the control of tension using conventional load cells:

1. Strip elongation and the associated width reduction are directly controlled and not inferred from tension settings. Elongation is set to produce the desired degree of strip flattening and width reduction. The elongation setting is independent of operating conditions and strip properties in the furnace.
2. Strip tension fluctuations due to imprecision of load cell monitors at low values are eliminated. This improves the uniformity of strip width and minimizes the chances for tension-induced creasing.
3. Better control of steady state elongation to ±0.05 percent (absolute) compared with values of ±5 percent quoted for control of tension in state-of-the-art load cell based system.
4. No underwidth strip will be produced at a change in strip cross section as may occur in tension control where elongation is concentrated in the smaller cross-section during transition. The associated overwidth length of the larger cross-section will be shorter than usual underwidth in tension control since tension control applies over longer strip lengths.
5. Elongation control will prevent those strip breaks in the controlled section which initiate with decreasing strip cross-section caused by damage, or overtension, or with a strength loss caused by strip overheating resulting from thermal inertia of the furnace coupled with a mass flow decrease. In load cell based tension controlled systems load is maintained while cross-section decreases leading to a progressive rise in strip tension and ultimately strip fracture. The instant response of elongation control would prevent such failure.

While several embodiments of this invention have been illustrated in the accompanying drawings and described hereinabove, it will be evident to those skilled in the art that changes and modifications may be made therein, without departing from the essence of this invention, as set forth in the appended claims.

We claim:

1. In apparatus in a continuous strip annealing furnace containing a portion in which it is desired to elongate a strip of metal and to control such elongation, the improvement comprising the provision of:

a first driven roll adjacent an upstream and of said portion and a second driven roll adjacent a downstream end of said portion, the rolls being such as to achieve frictional contact with the strip when the latter is entrained thereover, driving means for driving both said rolls such that the peripheral speed of the second roll is greater than the peripheral speed of the first roll, thereby elongating the strip, sensing means for sensing the elongation of the strip without measuring the load on the strip, and control means responsive to the sensed elongation of this trip for adjusting the rotational speed of one of said driven rolls with respect to the other, thus controlling said elongation.

2. The apparatus claimed in claim 1, in which said portion of the furnace is that in which the strip achieves it highest temperature.

3. The apparatus claimed in claim 1, in which the furnace has an upstream end and a downstream end, and in which the furnace includes, in order from the upstream end to the downstream end, a heating zone, a soaking zone, a primary cooling zone, an averaging zone and a final cooling zone, and in which said portion of the furnace is the soaking zone.

4. The apparatus claimed in claim 1, in which additional rolls are provided in said portion of the furnace, over which the strip is frictionally entrained, at least one of said additional rolls being a driven roll, and further means for controlling the peripheral speed of said last-mentioned driven roll in order to further adjust strip elongation within said portion.

5. The apparatus claimed in claim 3, in which said portion of the furnace contains additional roll over which the strip is frictionally entrained, at least one of the said additional rolls being a driven roll, and means for controlling the peripheral speed of said last-mentioned driven roll in order to further adjust strip elongation within said portion.

6. The apparatus claimed in claim 1, in which said sensing means includes means for determining the rotational speeds of said driven rolls by making measurements directly on said driven rolls.

7. The apparatus claimed in claim 1, in which said sensing means includes means for determining the rotational speeds of said driven rolls by making measurements on freely rotating, non-driven rolls adjacent to the said driven rolls.

8. The apparatus claimed in claim 1 in which the furnace has an upstream end and a downstream end, the furance including, in order from the upstream end to the downstream end, a heating zone, a soaking zone, and a cooling region comprising at least one gas jet cooling zone, the said portion of the furnace being the gas jet cooling zone.

9. The apparatus of claim 1, including means for sensing the elongation of the strip by measuring the difference in width of the strip between the first and the second rolls.

10. The apparatus of claim 3, in which said soaking zone has entrance and exit shoulders the apparatus including, means for sensing the elongation of the strip by measuring the difference in width of the strip at the entrance and exit shoulders of the soaking zone.

11. The apparatus of claim 1, in which said strip is under tension and the apparatus includes means for decreasing the tension on the strip as it approaches said portion of the furnace from the high level of tension required for strip tracking to a lower level of tension adapted for controlling the elongation of the strip in said portion without damaging the strip.

12. Apparatus for controlling elongation of a strip of metal in at least a portion of a continuous annealing furnace, comprising:

means for passing a strip of metal around a first driven roll upstream of said portion of the furnace, thence through said portion of the furnace, thence around a second driven roll downstream of said portion of the furnace, the strip undergoing frictional contact with both rolls, means for sensing the elongation of the strip by measuring the peripheral speed of the first and second rolls, and means for controlling strip elongation in response to the sensed elongation by adjusting the amount by which the peripheral speed of the second roll exceeds the peripheral speed of the first roll.

13. The apparatus of claim 12, including means for raising the strip to its highest temperature in the furnace in said portion of the furnace.

14. The apparatus of claim 12, in which the furnace has an upstream end and a downstream end, and in which the furnace includes, in order from the upstream end to the downstream end, a heating zone, a soaking zone, and a cooling zone, and in which said portion of the furnace is the soaking zone.

15. The apparatus of claim 12, in which said portion of the furnace contains additional rolls, means for entraining said strip over said additional rolls, means for driving at least one of the said additional rolls, and means for controlling the peripheral speed of said last-mentioned driven roll in order to further adjust strip elongation within said portion.

16. Apparatus for controlling elongation of a strip of metal in at least a portion of a continuous annealing furnace comprising:

means for passing a strip of metal around a first driven roll upstream of said portion of the furnace, then through said portion of the furnace, thence around a second driven roll downstream of said portion of the furnace, the strip undergoing frictional contact with both rolls, means for sensing the elongation of the strip by measuring the difference in width of the strip between the first and second rolls, and means for controlling strip elongation in response to the sensed elongation by adjusting the amount by which the peripheral speed of the second roll exceeds the peripheral speed of the first roll.

17. The apparatus of claim 12, in which said strip is under tension, the apparatus including means for decreasing the tension on the strip as it approaches said portion of the furnace from the high level of tension required for strip tracking to a lower tension adapted for controlling the elongation of the strip in said portion without damaging the strip.

18. The apparatus of claim 12, in which said portion has entrance and exit shoulders, the apparatus including means for decreasing the tension below the desired tension in said portion at the entrance and exit shoulders to minimize the elongation of the strip in said entrance and exit shoulder zones.

19. Apparatus for controlling elongation of a strip of metal in at least a portion of a continuous annealing furnace, comprising:

means for passing a strip of metal around a first driven roll upstream of said portion of the furnace, thence through said portion of the furnace, thence around a second driven roll downstream of said portion of the furnace, the strip undergoing frictional contact with both rolls, means for sensing the elongation of the strip, and means for controlling strip elongation which does not require load cells by adjusting the amount by which the peripheral speed of the second roll exceeds the peripheral speed of the first roll in response to the sensed elongation.

20. Apparatus for controlling elongation of a strip of metal in at least a portion of a continuous annealing furnace, comprising:

means for passing a strip of metal around a first driven roll upstream of said portion of the furnace, thence through said portion of the furnace, thence around a second driven roll downstream of said portion of the furnace, the strip undergoing frictional contact with both rolls, means for sensing the elongation of the strip by measuring the peripheral speed of the first and second rolls or by measuring the difference in width of the strip between the fist and second rolls, and means for controlling strip elongation in response to the sensed elongation by adjusting the amount by which the peripheral speed of the second roll exceeds the peripheral speed of the first roll.

* * * * *